US006540478B2

(12) United States Patent
Fiala et al.

(10) Patent No.: US 6,540,478 B2
(45) Date of Patent: Apr. 1, 2003

(54) BLADE ROW ARRANGEMENT FOR TURBO-ENGINES AND METHOD OF MAKING SAME

(75) Inventors: Andreas Fiala, Munich (DE); Adam Heisler, Petershausen (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 09/984,338

(22) Filed: Oct. 29, 2001

(65) Prior Publication Data

US 2002/0057966 A1 May 16, 2002

(30) Foreign Application Priority Data

Oct. 27, 2000 (DE) ..... 100 53 361

(51) Int. Cl.[7] ..... F01D 9/04
(52) U.S. Cl. ..... 415/194; 415/199.5
(58) Field of Search ..... 415/191, 193, 415/194, 195, 199.4, 199.5, 209.1

(56) References Cited

U.S. PATENT DOCUMENTS 910,266 A * 1/1909 Belluzzo ..... 415/195 X
1,539,395 A * 5/1925 Losel ..... 415/199.5 X
3,347,520 A * 10/1967 Owczarek ..... 415/195 X
3,953,148 A * 4/1976 Seippel et al. ..... 415/199.5 X
5,470,200 A * 11/1995 Tupov et al. ..... 415/194
5,486,091 A 1/1996 Sharma ..... 415/194
6,402,458 B1 * 6/2002 Turner ..... 415/195 X

FOREIGN PATENT DOCUMENTS

EP 0756667 2/1997

* cited by examiner

*Primary Examiner*—Edward K. Look
*Assistant Examiner*—Richard A. Edgar
(74) *Attorney, Agent, or Firm*—Crowell & Moring LLP

(57) ABSTRACT

A blade row arrangement for turbo-engines has an axial construction with two guide blade rows fixedly positioned relative to one another and having a different number of blades while the blade pitch is constant in each case, and having a moving blade row arranged between the two guide blade rows. The blades of the first guide blade row, in a first partial area of the row, successively have an identical axial offset; the axial offset being selected as a function of the blade number ratio of the two guide blade rows such that it increases the effective flow-off cross-section when the first guide blade row has more guide blades than the second guide blade row and reduces the effective flow-off cross-section when the first guide blade row has less guide blades than the second guide blade row. The blades of the first guide blade row, in a second partial area of the row, successively have an axial offset which is opposite in relation to the blades in the first partial area. The axial offset for the respective sections may be different in size as well as axial direction.

41 Claims, 4 Drawing Sheets

BLADE ROW ARRANGEMENT FOR TURBO-ENGINES AND METHOD OF MAKING SAME

BACKGROUND AND SUMMARY OF THE INVENTION

This application claims the priority of German Patent Document No. 100 53 361.2, filed in Germany, Oct. 27, 2000, the disclosure of which is expressly incorporated by reference herein.

The invention relates to a blade row arrangement for turbo-engines of an axial-flow coaxial construction. Preferred embodiments of the invention relate to a blade row arrangement for turbo-engines, particularly for gas turbines, in an axial-flow coaxial construction with two guide blade rows situated in a fixed axial and circumferential position relative to one another, having a different number of blades and each having a constant pitch angle between their blades, as well as having a moving blade row rotatably arranged between the guide blade rows, the upstream guide blade row having a flow-off direction with an axial and circumferential component comparable with respect to the size.

Promising starting points for optimizing the efficiency of turbo-engines by fluidic measures exist in the form of a fixed defined assignment of the circumferential positions of successive guide blade rows or of successive, synchronously rotating moving blade rows. This principle, which in technical terminology has become known as "clocking" or, more concretely, as "stator or rotor clocking", has the object of leading the wakes originating from the individual blades of a first row of blades in a defined fluidically optimal circumferential position to a similar row of blades which is next in the downstream direction. If two "clocked" rows of guide blades are involved, it should be taken into account that the wakes are considerably influenced and changed by the moving blade row rotating between the guide blade rows, particularly because of displacements, deformations and separations. The complexity of these flow patterns has the result that so far there are no unambiguous reliable rules for a constructive "clocking".

European Patent Document EP 0 756 667 B1 (corresponding U.S. Pat. No. 5,486,091) protects a "clocking" method in which the wakes of a first blade row are directed by a second blade row with a relative motion to the blade inlet edges of a third blade row stationary relative to the first, in which case a maximal circumferential deviation between the wake and the inlet edge of plus/minus 12.5 percent of the blade pitch should be permissible.

Tests have not confirmed that this type of "clocking" would generally increase the efficiency.

Irrespective of how the optimal relative circumferential position of the blade rows is selected, it is a prerequisite of "clocking" according to the above-mentioned prior art arrangements that the coordinated blade rows pertaining to the same relative system (stator or rotor) have the same number of blades when the blade pitch is circumferentially constant.

It is an object of the invention to suggest a blade row arrangement with two guide blade rows and one moving blade row arranged between the latter which, despite different blade numbers of the two guide blade rows, permits a fluidically advantageous relative circumferential positioning of the guide blade rows in the sense of a "clocking".

This object is achieved in certain preferred embodiments by providing a blade row arrangement for turbo-engines, particularly for gas turbines, in an axial-flow coaxial construction with two guide blade rows situated in a fixed axial and circumferential position relative to one another, having a different number of blades and each having a constant pitch angle between their blades, as well as having a moving blade row rotatably arranged between the guide blade rows, the upstream guide blade row having a flow-off direction with an axial and circumferential component comparable with respect to the size, wherein the blades of the upstream first guide blade row, in one of a first cohesive partial area T1 of the row and a partial area T1 distributed in several separate sectors along the row circumference, successively have an axial offset $\Delta m$ of the same amount as well as in the same direction, wherein the axial offset $\Delta m$, as a function of the blade number ratio Z1/Z2 of the first and the second guide blade row is selected such that, at Z1>Z2, the axial offset $\Delta m$ increases an effective flow-off cross-section Aeff between the blades, and such that, at Z1<Z2 reduces the flow-off cross-section, and wherein the blades of the first guide blade row, in one of a second cohesive partial area T2 of the row and a partial area T2 of the row distributed in several separate sectors along the row circumference, successively have an axial offset $\Delta n$ which has the same size or varies and is oppositely directed in relation to $\Delta m$.

According to the invention, the upstream guide blade row—despite a constant pitch angle of the blades along the circumference—is constructed with two different partial areas which are individually cohesive or distributed in several separate sectors along the row circumference, in both areas each blade being axially offset in a defined manner with respect to its neighboring blade. Thus, the stacking axes of the blades are no longer—as customary—situated in a common radial plane but on screw surfaces with a constant or varying pitch, in which case concrete blade points are correspondingly situated on helical lines. The first partial area with $\Delta m$ describes, for example, a "forward screw"; the second partial area with $\Delta n$ describes a "backward screw" connecting the ends of the $\Delta m$ area, or vice versa. In the sense of a "clocking", only the first partial area acts with a constant defined axial offset $\Delta m$ from blade to blade; the second partial area is used only for the return of the entire added-up axial offset in a linear or non-linear manner by means of $\Delta n$ while avoiding relevant fluidic disadvantages. Since the guide blade rows have a diagonal flow-off with a strong circumferential component, the axial offset between adjacent blades effectively causes an enlargement or reduction of the outlet-side flow cross-section. In the first partial area, the axial offset $\Delta m$ is constant and is selected as a function of the blade number ratio of the two guide blade rows. If the blade number Z2 of the second guide blade row is smaller than that of the first guide blade row (Z1), the effective flow-off cross-section of the first guide blade row is enlarged by means of $\Delta m$; if Z2 is larger than Z1, the flow-off cross-section of the first row is reduced by means of an opposite axial offset. In the second partial area of the row with the axial offset $\Delta n$, the opposite will in each case apply correspondingly; here, no targeted "clocking effect" occurring at the second downstream guide blade row.

By the variation of the effective flow-off cross-sections of the first guide blade row, the invention results in a certain asymmetry of the flow distribution and thus of the mass distribution in the ring-shaped flow duct cross-section. This has, among others, the advantage that instabilities and disturbances which, in the case of symmetrical or periodic conditions, may expand further over the circumference, can be displaced and partially prevented. Furthermore, by means of the invention, reactions can take place in a targeted manner to certain asymmetries in the afflux.

The "clocking effect" primarily endeavored by means of the invention, because of its angular limitation may, for example, also be called "partial clocking" or "sector clocking".

Further features of preferred embodiments of the invention are described below and in the claims.

Other objects, advantages and novel features of the present invention will become apparent from the following detailed description of the invention when considered in conjunction with the accompanying drawings.

DETAILED DESCRIPTION OF THE INVENTION

Figure 1:
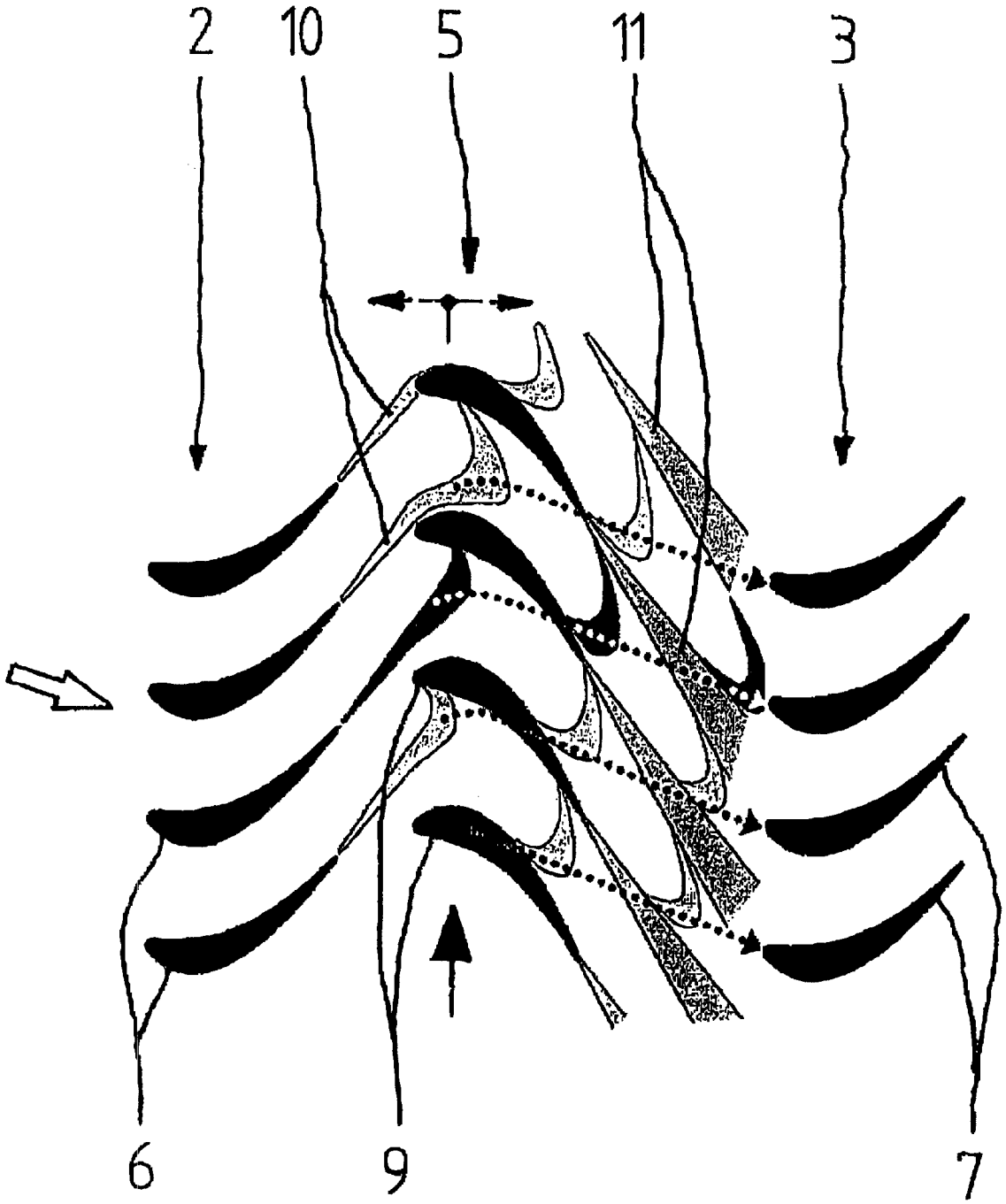
FIG. 1 is an explanatory, not-true-to-scale representation of a blade row arrangement with two guide blade rows and one moving blade row arranged in-between, constructed according to preferred embodiments of the invention.
Figure 2:
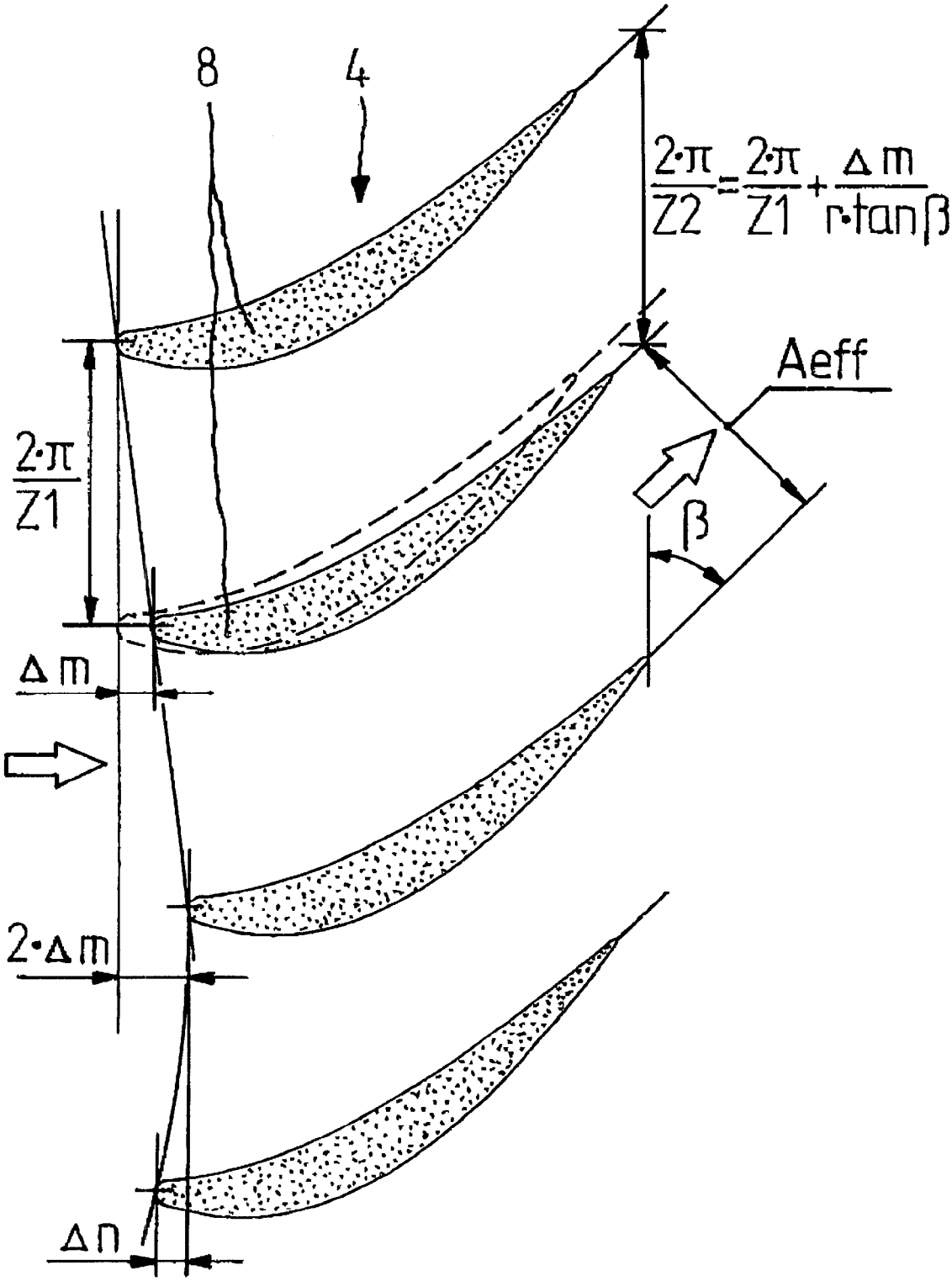
FIG. 2 is an explanatory, not-true-to-scale representation of four blade profiles of a guide blade row with an axial offset.

For a better understanding, it should first be pointed out that FIGS. 1 and 2 show the blade rows as if they were plane rows—without any curvature with parallel blades—, in which case only a concrete profile is shown for each blade. This type of representation is much simpler, clearer and more easily understandable than a realistic spatial representation with radial three-dimensional blades, etc.

In FIG. 1, the flow through the blade row arrangement takes place from the left to the right; a guide blade row 2 being situated upstream (left); a moving blade row 5 being situated in the center; and another guide blade row 3 being situated downstream (right). The blades of the rows 2, 5 and 3 have the reference numbers 6, 9 and 7. The rotating direction of the moving blade row is indicated below the latter by means of an upward-pointing black arrow. Above the moving blade row 5, a horizontal double arrow is indicated by a broken line and points out that the row may be constructed axially displaceably in order to additionally influence the course of the flow. The colors gray and black indicate the—so-called—wakes 10 of the guide blade row 2, the wakes 11 of the moving blade row 5, and the change of the wakes 10 on their path through the rows 2 and 5; the dotted curves and straight lines describing the paths of the wakes in relation to the unmoved stator system. The axial offset of the blades concerns only the upstream guide blade row 2 and is not shown in FIG. 1. FIG. 1 also does not show that the guide blade rows 2 and 3 have different numbers of blades.

FIG. 2 therefore shows a guide blade row 4 which is comparable to the row 2 in FIG. 1 and has axially offset blades 8 according to the invention. The pitch angle between all blades 8 is constant, so that the vertical offset is in each case constant in the figure. See the statement $2\pi \div Z1$ on the left, which corresponds to the radian measure divided by the radius r, that is, to the radius-related radian measure from one blade to the next. From above, the first, second and third blade are axially (here, horizontally) offset with respect to one another in each case by an amount $\Delta m$, in which case the blades move from above in the downward direction farther to the right, that is, downstream. The flow-off from the guide blade row 4 takes place at an angle $\beta$ of approximately 45° diagonally to the right upward, that is, with a comparatively large axial and circumferential component. This diagonal flow-off has the result that an axial offset between two blades necessarily results in a change of the effective flow-off cross-section Aeff. In the present geometry, the flow-off cross-section is enlarged in comparison with an arrangement of the blades without an axial offset $\Delta m$. See in this regard the position of the second blade from above indicated by a broken line without an axial offset in relation to the uppermost blade. The enlargement of the flow-off cross-section can also be recognized by the fact that the vertical distance between the flow lines originating from the blade trailing edges, here, the radius-related radian measure $2\pi \div Z2$, is larger than the measure $2\pi \div Z1$, specifically by the added value $\Delta m \div (r.\tan\beta)$. In this regard, see the equation at the right-hand top in the figure. This corresponds to an effective adaptation of the guide blade row 4 to a guide blade row which is situated downstream, is not shown here and has a larger spacing of the blades; that is, a smaller number of blades $Z2 > Z1$. Because the blade numbers Z1, Z2 in the respective row are constant along the duct height, that is, they are independent of the radius r, tan $\beta$ should at least along the largest portion of the radial duct height be selected to be inversely proportional the radius r.

For an adaptation to a downstream guide blade row with a larger number of blades, that is, $Z2 > Z1$, the flow-off cross-sections of the blades 8 would have to be reduced in relation to a row without any axial offset $\Delta m$. In the figure, the upper three blades would then have to be moved from above in the downward direction farther to the left, in each case, by a constant axial offset $\Delta m$ to the left. This principle is easily understandable and is therefore not shown separately.

It should be noted that the lowermost blade in FIG. 2 relative to the blade situated above that blade has no longer moved by $\Delta m$ to the right but by an axial offset $\Delta n$ to the left. In reality, it is fluidically not useful to arrange all blades of a guide blade row in the sense of a helical line with a continuous axial offset, in which case a large axial jump with very negative fluidic consequences would exist between the first and the last blade of such a row. The invention therefore provides that a first partial area T1 of the guide blade row be equipped with a continuous axial offset $\Delta m$, and in a second partial area T2, the sum of all $\Delta m$ be completely canceled again by means of opposite axial offsets $\Delta n$.

Figure 3:
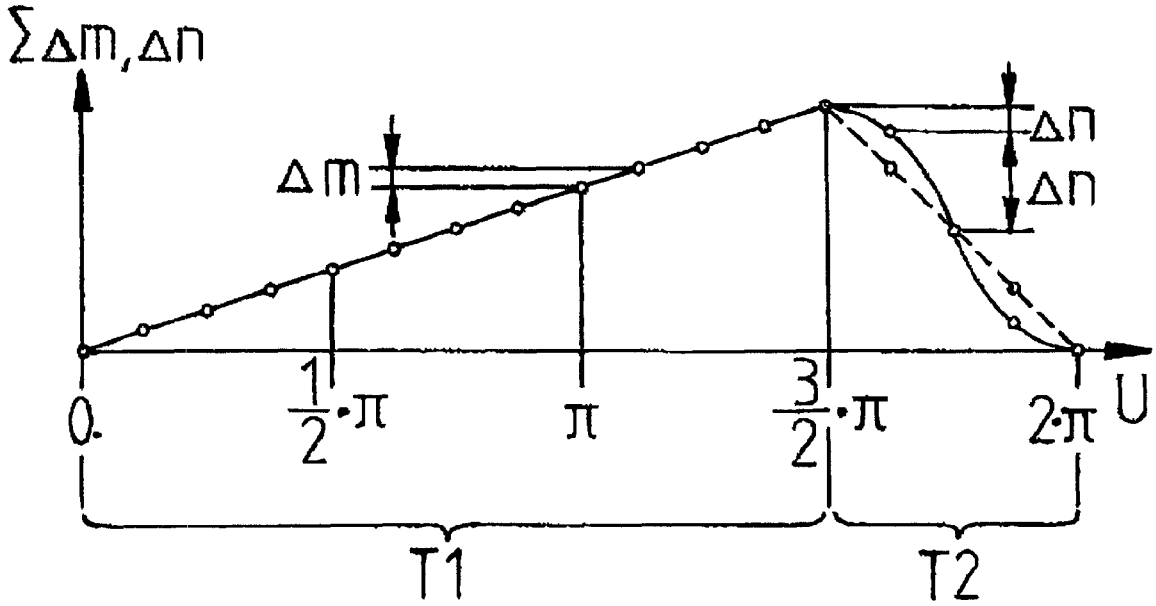
FIG. 3 is a diagram with the course of the axial offset over the guide blade row circumference.

This principle can be best understood on the basis of FIG. 3 which illustrates the course of the axial offset $\Sigma\Delta m$, $\Delta n$ along the circumference U of the guide blade row, the concrete blade positions being marked by small circles. A first partial area T1 is shown; here, a partial area T1 extending over 270°, with a linearly rising axial offset, from blade to blade in each case by $\Delta m$. This is followed by a second partial area T2; here extending over 90°, in which the axial offset decreases again successively, either linearly (broken line) or according to an S-cure, for example, a cosine curve. With respect to the S-curve, it is shown that the axial offset $\Delta n$ may vary from blade to blade. Which type of a curve would be more favorable here, will have to be determined by tests, among other things. The blade (small circle) at the ordinate 0 is identical with the blade at the ordinate $2\pi$, because the row circumference closes here. The present diagram therefore outlines 16 different blade positions. In reality, the blade numbers will, as a rule, clearly be larger. The ratio of sizes of the partial areas T1 and T2 is indicated only as an example, in which case $T1 > T2$ should be endeavored. Since in practice, the blade numbers Z1 and Z2 differ only a little, relatively small axial offsets Δm are sufficient for applying the invention.

Figure 4:
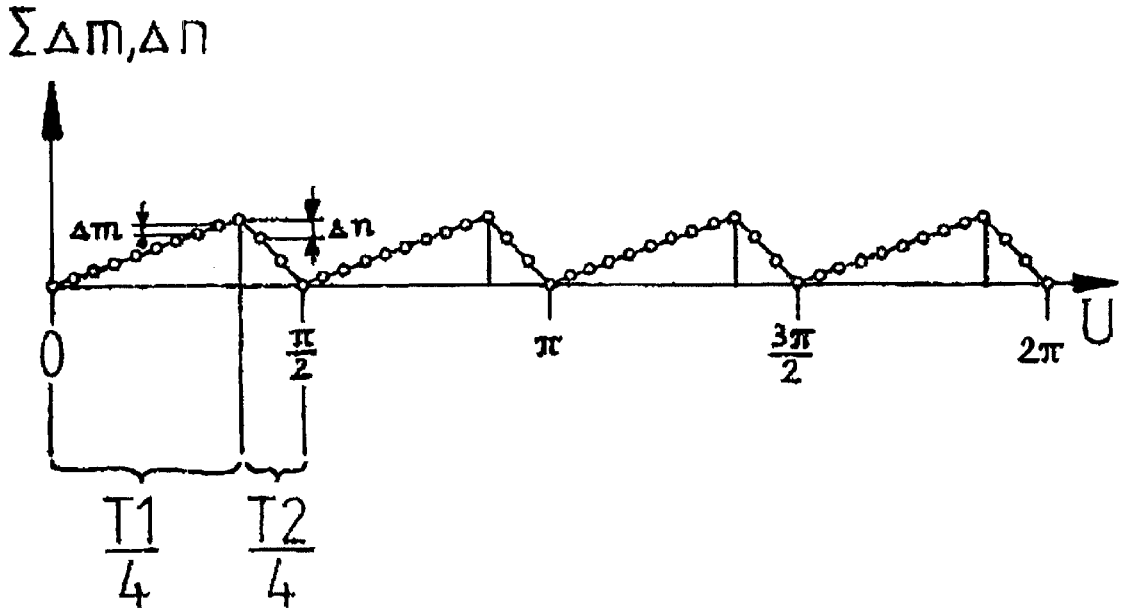
FIG. 4 is a diagram comparable to FIG. 3 but with a course of the axial offset periodically varying in four sectors.

FIG. 4 shows the course of the axial offset ΣΔm, Δn along the circumference U of a guide blade row, whose partial areas T1, T2, in contrast to the embodiment of FIG. 3, are not arranged in an individually cohesive manner but are each distributed in four separate sectors T1÷4, T2÷4 along the row circumference, so that a quadruply periodic course is obtained in each case with a positive and negative axial offset Δm, Δn. The division into four sectors is used as example; they may also be two, three, five or more sectors. The course of the partial area sectors T2÷4 is linear here in each case. Naturally, S-curves can also be used instead, as illustrated in FIG. 3. As a result of the division of the "clocked" partial area T1 and of the partial area T2 into, in each case, several separate sectors, asymmetries of the flow field along the duct cross-section—as in an embodiment according to FIG. 3—can be avoided, in which case, these may, however, also be desirable.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Blade row arrangement for turbo-engines, in an axial-flow coaxial construction, comprising:

two guide blade rows situated in a fixed axial and circumferential position relative to one another, said guide blade rows having a different number of blades and each having a constant pitch angle between respective blades, and a moving blade row rotatably arranged between the guide blade rows, the upstream guide blade row having a flow-off direction with an axial and circumferential component comparable with respect to size, wherein the blades of the upstream guide blade row, in one of a first cohesive partial area T1 of the guide blade row and a partial area T1 distributed in several separate sectors along a row circumference, successively have an axial offset Δm of the same amount as well as in the same direction, wherein the axial offset Δm, as a function of a blade number ratio Z1/Z2 of the first and the second guide blade rows is selected such that, at Z1>Z2, the axial offset Δm increases an effective flow-off cross-section Aeff between the blades and such that, at Z1<Z2 reduces the flow-off cross-section, and wherein the blades of the upstream guide blade row, in one of a second cohesive partial area T2 of the guide blade row and a second partial area T2 of the guide blade row distributed in several separate sectors along the row circumference, successively have an axial offset Δn which has the same size or varies and is oppositely directed in relation to Δm.

2. Blade row arrangement according to claim 1, wherein, in the first partial area T1, a relationship between the blade numbers Z1, Z2, a local blade row radius r, a flow-off angle β of the upstream guide blade row, measured in a circumferential direction at blade trailing edges, and the axial offset Δm along a range of a radial blade height which is as large as possible corresponds to:

$$2\pi \div Z2 = 2\pi \div Z1 \pm \Delta m \div (r \cdot \tan \beta),$$

and wherein, with an always positively computed Δm, the plus sign applies to Z1>Z2 and the minus sign applies to Z1<Z2.

3. Blade row arrangement according to claim 2, wherein the moving blade row arranged between the two guide blade rows is constructed to be adjustable in axial position.

4. Blade row arrangement according to claim 2, wherein the partial area T1 of the guide blade row with the axial offset Δm extends cohesively or in a sum of the sectors over a larger angle than the second partial area T2 with the axial offset Δn.

5. Blade row arrangement according to claim 4, wherein the moving blade row arranged between the two guide blade rows is constructed to be adjustable in axial position.

6. Blade row arrangement according to claim 2, wherein a helical-line curve which, in the second partial area T2, determines axial blade positions with the axial offset Δn and can be represented on a circular cylinder, when laid out in a plane, forms a straight line or a curve curved in an S-shape with a curvature reversal point.

7. Blade row arrangement according to claim 6, wherein the moving blade row arranged between the two guide blade rows is constructed to be adjustable in axial position.

8. Blade row arrangement according to claim 6, wherein the partial area T1 of the guide blade row with the axial offset Δm extends cohesively or in a sum of the sectors over a larger angle than the second partial area T2 with the axial offset Δn.

9. Blade row arrangement according to claim 8, wherein the moving blade row arranged between the two guide blade rows is constructed to be adjustable in axial position.

10. Blade row arrangement according to claim 1, wherein a helical-line curve which, in the second partial area T2, determines axial blade positions with the axial offset Δn and can be represented on a circular cylinder, when laid out in a plane, forms a straight line or a curve curved in an S-shape with a curvature reversal point.

11. Blade row arrangement according to claim 10, wherein the moving blade row arranged between the two guide blade rows is constructed to be adjustable in axial position.

12. Blade row arrangement according to claim 10, wherein the curve is a cosine curve section.

13. Blade row arrangement according to claim 10, wherein the partial area T1 of the guide blade row with the axial offset Δm extends cohesively or in a sum of the sectors over a larger angle than the second partial area T2 with the axial offset Δn.

14. Blade row arrangement according to claim 13, wherein the moving blade row arranged between the two guide blade rows is constructed to be adjustable in axial position.

15. Blade row arrangement according to claim 1, wherein the partial area T1 of the guide blade row with the axial offset Δm extends cohesively or in a sum of the sectors over a larger angle than the second partial area T2 with the axial offset Δn.

16. Blade row arrangement according to claim 15, wherein the moving blade row arranged between the two guide blade rows is constructed to be adjustable in axial position.

17. Blade row arrangement according to claim 15, wherein the partial area T1 extends over an angle of 270°.

18. Blade row arrangement according to claim 1, wherein the moving blade row arranged between the two guide blade rows is constructed to be adjustable in axial position.

19. Blade row arrangement according to claim 18, wherein the moving blade row is a rotor-fixed blade row on an axially displaceable rotor.

20. A blade row arrangement for a turbo engine, comprising:

a fixed first guide blade row with a first number of first guide blades spaced circumferentially from one another by a constant pitch angle, a fixed second guide blade row with a second number of second guide blades spaced circumferentially from one another by a constant pitch angle, said second number of second guide blades being different than the first number of first guide blades, and a movable third guide blade row disposed coaxially with and between the first and second guide blade rows, wherein the first guide blade row includes a first section with a first plurality of adjacent first guide blades disposed offset axially with respect to one another by a first distance in a first axial direction and a second section with a second plurality of adjacent first guide blades offset axially with respect to one another by a second distance in a second axial direction opposite the first axial direction.

21. The blade row arrangement of claim 20, wherein the first distance is different than the second distance.

22. The blade row arrangement of claim 20, wherein said first guide blade row includes only one first section and one second section which together surround a turbo engine axis.

23. The blade row arrangement of claim 20, wherein said first guide blade row includes a plurality of said first and second sections disposed alternating with one another surrounding a turbo engine axis.

24. The blade row arrangement of claim 20, wherein the first plurality is different than the second plurality.

25. The blade row arrangement of claim 24, wherein the first distance is different than the second distance.

26. The blade row arrangement of claim 20, wherein the first distance is selected to increase an effective outflow cross-section between trailing edges of adjacent first guide blades of said first plurality of first guide blades when said first number is greater than said second number.

27. The blade row arrangement of claim 26, wherein the first distance is different than the second distance.

28. The blade row arrangement of claim 26, wherein the first plurality is different than the second plurality.

29. The blade row arrangement of claim 28, wherein the first distance is different than the second distance.

30. The blade row arrangement of claim 20, wherein the first distance is selected to decrease an effective outflow cross-section between trailing edges of adjacent first guide blades of said first plurality of first guide blades when said first number is smaller than said second number.

31. The blade row arrangement of claim 30, wherein the first plurality is different than the second plurality.

32. The blade row arrangement of claim 30, wherein the first distance is different than the second distance.

33. The blade row arrangement of claim 32, wherein the first distance is different than the second distance.

34. A method of making a blade row arrangement for a turbo engine which includes:

a fixed first guide blade row with a first number of first guide blades spaced circumferentially from one another by a constant pitch angle, a fixed second guide blade row with a second number of second guide blades spaced circumferentially from one another by a constant pitch angle, said second number of second guide blades being different than the first number of first guide blades, and a movable third guide blade row disposed coaxially with and between the first and second guide blade rows, said method comprising selecting the number and location of the guide blades on the first guide blade row such that the first guide blade row includes a first section with a first plurality of adjacent first guide blades disposed offset axially with respect to one another by a first distance in a first axial direction and a second section with a second plurality of adjacent first guide blades offset axially with respect to one another by a second distance in a second axial direction opposite the first axial direction.

35. The method of claim 34, wherein the first distance is different than the second distance.

36. The method of claim 34, wherein the first distance is selected to increase an effective outflow cross-section between trailing edges of adjacent first guide blades of said first plurality of first guide blades when said first number is greater than said second number.

37. The method of claim 34, wherein the first distance is selected to decrease an effective outflow cross-section between trailing edges of adjacent first guide blades of said first plurality of first guide blades when said first number is smaller than said second number.

38. The method of claim 34, wherein said first guide blade row includes only one first section and one second section which together surround a turbo engine axis.

39. The method of claim 34, wherein said first guide blade row includes a plurality of said first and second sections disposed alternating with one another surrounding a turbo engine axis.

40. The method of claim 34, wherein the first plurality is different than the second plurality.

41. The method of claim 40, wherein the first distance is different than the second distance.

* * * * *